United States Patent [19]

Graf

[11] 4,105,112

[45] Aug. 8, 1978

[54] LOCKABLE SHIPPING BOX

[75] Inventor: John W. Graf, Montreux, Switzerland

[73] Assignee: Howmedica Inc., New York, N.Y.

[21] Appl. No.: 767,386

[22] Filed: Feb. 10, 1977

[51] Int. Cl.[2] ..... B65D 55/14; G09F 3/08; E05B 65/52

[52] U.S. Cl. ..... 206/1.5; 40/313; 70/63; 206/45.23

[58] Field of Search ..... 206/1.5, 45.23, 45.2; 70/63; 40/313, 312, 307

[56] References Cited

U.S. PATENT DOCUMENTS

| | | | |
|---|---|---|---|
| 571,169 | 11/1896 | McCartney | 206/1.5 |
| 1,421,964 | 7/1922 | Langford | 40/312 |
| 2,897,034 | 7/1959 | Kalen | 206/45.23 |
| 3,125,873 | 3/1964 | Robinson | 70/63 |
| 3,338,464 | 8/1967 | Callihan et al. | 40/312 |

FOREIGN PATENT DOCUMENTS

| | | | |
|---|---|---|---|
| 256,466 | 8/1926 | United Kingdom | 70/63 |

*Primary Examiner*—William T. Dixson, Jr.
*Attorney, Agent, or Firm*—Connolly and Hutz

[57] ABSTRACT

A lockable box has a tray and cover hinged together at the open rear end of the cover and locked at their opposite ends. A pair of detent spring fingers extending upwardly from the end of the tray lock over shoulders within the unhinged end of the cover. The detent spring fingers are released to open the box by inserting key lugs through holes in the lid of the cover in line with the spring detent fingers to disengage them from the cover. The cover and a tray are hinged together by a pair of elongated combination slide and hinge pins extending out from the rear midportions of the sides of the tray, whose longer dimension rotatably engages within hinge sockets at the rear ends of adjoining longitudinal grooves within the sides of the cover. Slide pins within the sides of the open rear end of the cover engage within longitudinal grooves in the lower outsides of the tray for helping guide the nesting movement of the tray and cover in conjunction with the combination hinge and slide guide pins on the tray sliding within the longitudinal grooves within the sides of the cover. The bottom and top edges of the slide guide pins are reduced by flats to leave arcuate side edges which rotatably engage within the enlarged hinge sockets. The reversible address plate is locked on the closed box by locking lugs extending upwardly from the sides of the tray which engage into notches on the address plate through holes in the lid of the cover when the cover is closed down over the tray.

13 Claims, 12 Drawing Figures

LOCKABLE SHIPPING BOX

BACKGROUND OF THE INVENTION

It is often necessary to ship materials in a steady routine back and forth from one address to another. In such service, it would be very helpful to have a permanent lockable box and address plate, which can easily be changed to facilitate shipment in both directions. Such a box would be particularly convenient for shipping sets of artificial teeth back and forth from a dentist to a supplier to permit the supplier to replenish the set when substantially depleted. An object of this invention is, therefore, to provide a relatively simple and economical lockable box having a reversible address plate for shipping articles back and forth between two addresses.

SUMMARY

In accordance with this invention the cover of the box is locked on the tray by a releasable security lock and the reversible address plate is automatically locked to the box when the cover is closed over the tray. A particularly effective form of such a box has detent spring fingers on an end of the tray for engaging onto shoulders within the lid. The spring fingers are conveniently unlocked by inserting rods through the cover which may have a connecting handle which serves as a foot for supporting the box in an inverted inclined dispensing position. A convenient form of such a box has a cover with an open rear end which is hinged to the tray by pins extending outwardly from the rear middle of the hinged end of the tray, which engage in an enlarged terminal end of the longitudinal groove in the inner sides of the cover. The enlargement in the end of the groove in the cover is engaged by the elongated width of the pin to allow opening and closing rotation of the cover relative to the tray. When the cover is rotated to an inverted position, its lid lies below the bottom of the tray and a sliding movement of the tray and inverted cover is guided by sliding the shorter height of the pins along the grooves within the inner sides of the cover. Such sliding movement is also guided by insertion of a pair of auxiliary slide guide pins extending within the sides of the cover adjacent its open rear end and lid, within a lower pair of guide grooves in the lower outsides of the tray. The entrance to the lower grooves is upwardly curved to permit the auxiliary slide guide pins to enter into them when the cover is rotated about its hinge to an inverted position. A pair of arcuate slots are also provided in the upper sides of the tray adjacent its hinged rear end for receiving the auxiliary guide pins within the open rear end of the cover when it is rotated closed over the tray. The reversible address plate is slid into engagement with a cutout in the lid and automatically locked to it when the cover is closed by insertion of a pair of lugs extending upwardly from a side of the tray through a pair of holes in the lid of the cover and into locking notches in the reversible address plate.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENT

Figure 11:
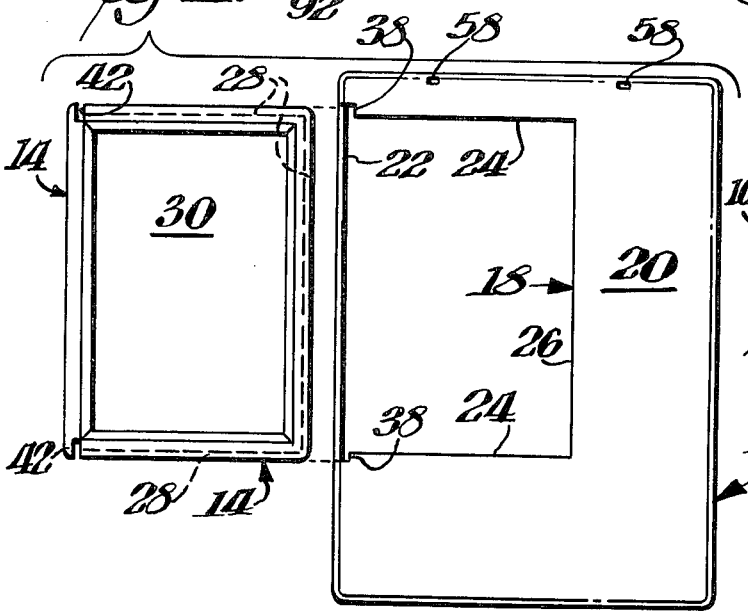
FIG. 11 is an exploded view of the lid of the box shown in FIGS. 1–10 in conjunction with the reversible address plate just out of engagement therewith.

In FIGS. 1–8 is shown a closed and locked box 10 for shipping articles, such as artificial teeth 12 (shown in FIG. 12), between two addresses, such as between a dentist and a supplier of artificial teeth. Box 10 has a reversible address plate 14 mounted and locked on its cover 16 by inserted engagement, from the position shown in FIG. 11, with cutout 18 in lid 20. Cutout 18 extends a short distance through side 22 of lid 20 to expose two side edges 24 and one rear edge 26 of cutout 18 for engagement by three sided groove 28 in frame 30 of reversible address plate 14. Reversible address plate 14 is automatically locked to cover 16 by the upward engagement of lugs 32 extending upwardly from side 34 of tray 36 when cover 16 is closed down over tray 36. Lugs 32 extend through holes 38 in lid 20 of cover 16 and into locking notches 42 in two corners of frame 30 of reversible address plate 14 to automatically lock plate 14 onto cover 16 when it is closed on tray 36.

Figure 7:
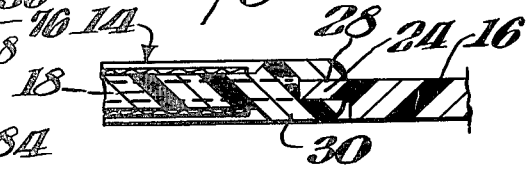
FIG. 7 is a cross-sectional view taken through FIG. 1 along the line 7—7.

FIG. 7 shows the engagement of groove 28 in the edges of frame 30 of locking plate 14 over reduced side edge 24 of cutout 18. Rear edge 26 is similarly reduced. Reversible address plate 14 has a separate address block 44 on each of its sides, each of which is printed with a different address. The plate is inserted with the correct address up and visible before shipment.

Figure 5:
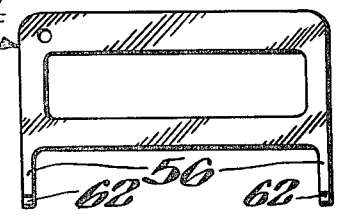
FIG. 5 is a front elevational view of the unlocking key rod handle shown in FIG. 3.
Figure 6:
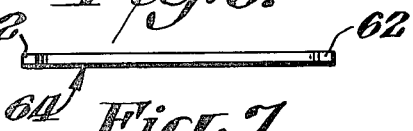
FIG. 6 is a bottom plan view of the unlocking key rod handle shown in FIG. 5.
Figure 4:
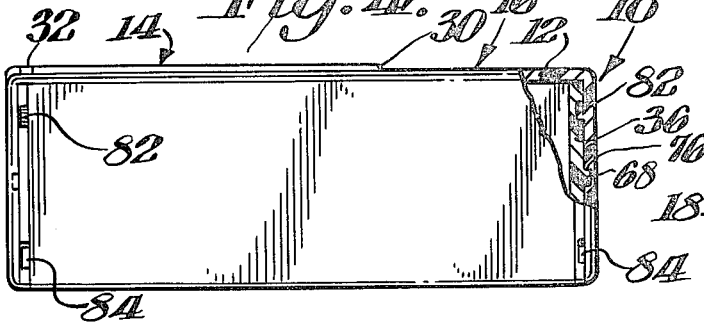
FIG. 4 is a right end elevational view of the box shown in FIGS. 1–3.
Figure 8:
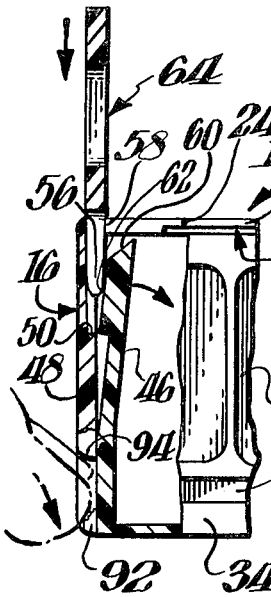
FIG. 8 is a cross-sectional view taken through FIG. 1 along the line 8—8.

FIGS. 3–6 show the locked configuration of box 10 in which spring detent fingers 46 in the unhinged front end 48 of tray 36 are engaged over internal shoulders 50 within the unhinged end 52 of cover 16. FIG. 8 shows hooked end 54 of spring fingers 46 being disengaged from internal shoulder 50 by insertion of unlocking key rods 56 through holes 58 in cover 16 past tapered camming edge 60 of spring finger 46 under pressure of tapered tips 62 of unlocking key rods 56. A pair of unlocking key rods 56 are connected by handle 64 as shown in FIG. 5 to facilitate unlocking insertion of rods 56 through cover 16 and the subsequent inclined disposition of the open nested inverted box 10 as shown in FIGS. 10 and 12.

Figure 9:
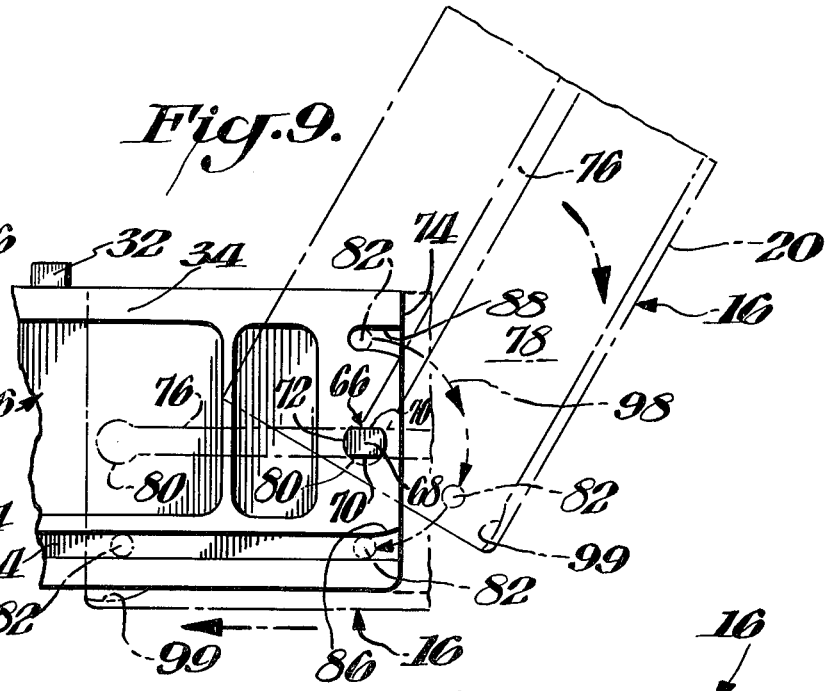
FIG. 9 is a partial side elevational view of the tray of the box shown in FIGS. 1–4 with the cover and its hinged motion shown in phantom outline.

The hinged rotation of cover 16 relative to tray 36 is shown in FIG. 9. Cover 16 is shown in phantom partially rotated upwardly away from tray 36 about hinge 66 provided by combination rotation and slide guide pin 68 which is a wider than high by virtue of flats 70 on the top and bottom of pins 68. The sides 72 of pin 68 are arcs of a circle. Pins 68 extend outwardly from the sides 34 of tray 36 adjacent the midportion of its hinged rear end 74. Pins 68 are engaged within grooves 76 extending longitudinally within the midportion of sides 78 of cover 16. In the opened position of cover 16 shown in phantom in FIG. 9, pin 68 is locked within enlarged end 80 of groove 76 to prevent sliding movement of cover 16 relative to tray 36 except in the open nested position shown in FIG. 10. Tray 36 may be slid parallel to inverted cover 16 by the sliding movement of the shorter dimensions of pins 68 within groove 76.

FIG. 9 also shows the engagement of auxiliary slide pins 82 within lower groove 84 in the bottom of outer sides 34 of tray 36 to facilitate sliding movement of tray 36 to nest within inverted cover 16, as shown in phantom outline. Also shown in phantom outline is an intermediate position of cover 16 and auxiliary pin 82. Movement of auxiliary slide pins 82 into and out of the end of lower groove 84 in the lower outer sides of tray 36 is afforded by arcuate entrance 86. When cover 16 is rotated closed about hinge 66, auxiliary slide pins 82 are received in arcuate grooves 88 in the upper sides 34 at the hinged rear end 74 of tray 36.

Figure 1:
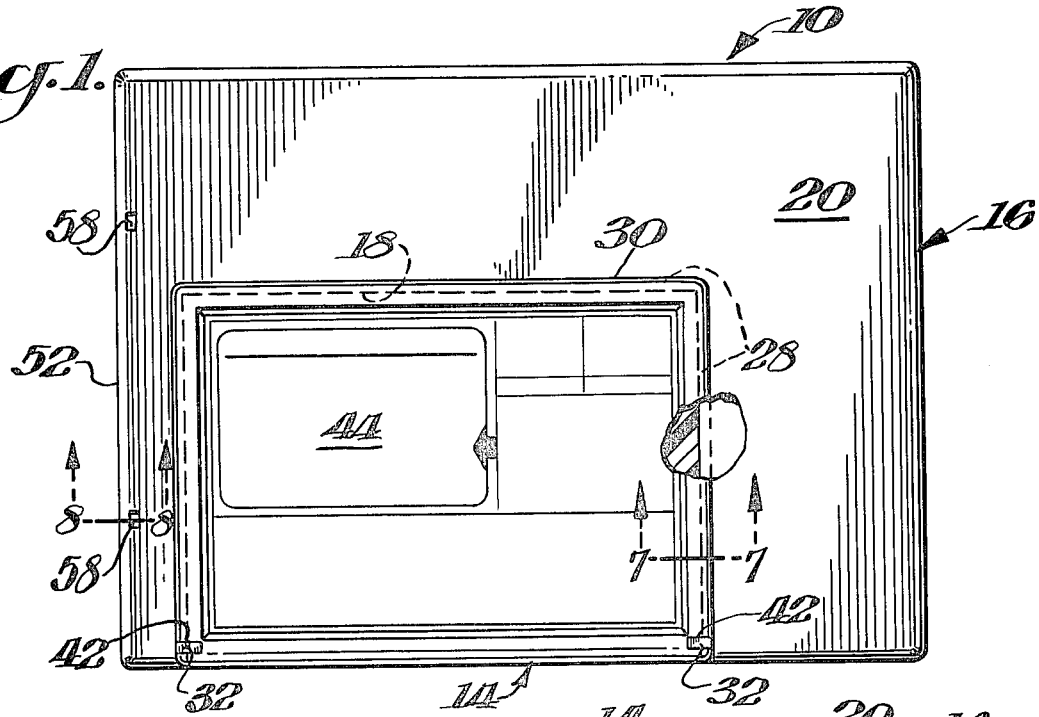
FIG. 1 is a top plan view of a lockable box which is one embodiment of this invention.
Figure 2:
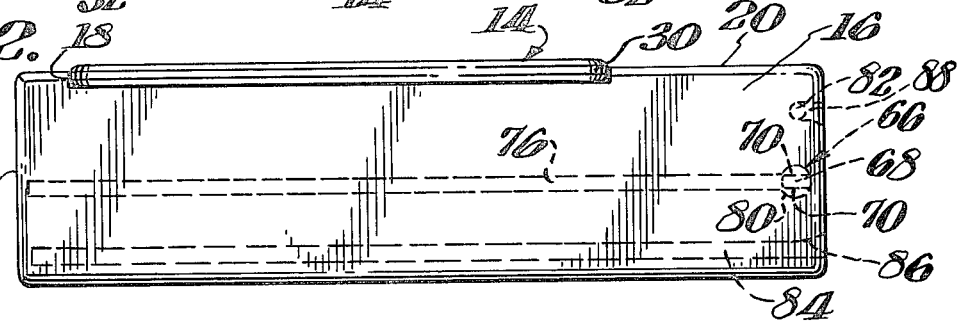
FIG. 2 is a side elevational view of the box shown in FIG. 1.
Figure 3:
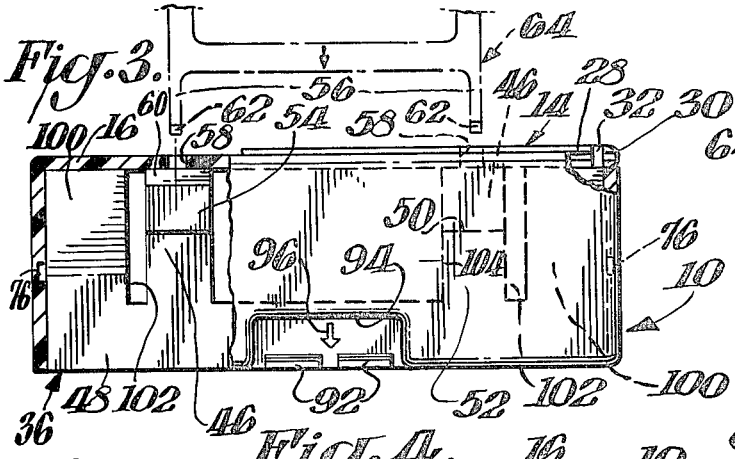
FIG. 3 is a left end elevational view of the box shown in FIGS. 1 and 2 in the locked condition with the unlocking key rods in position for unlocking it.
Figure 10:
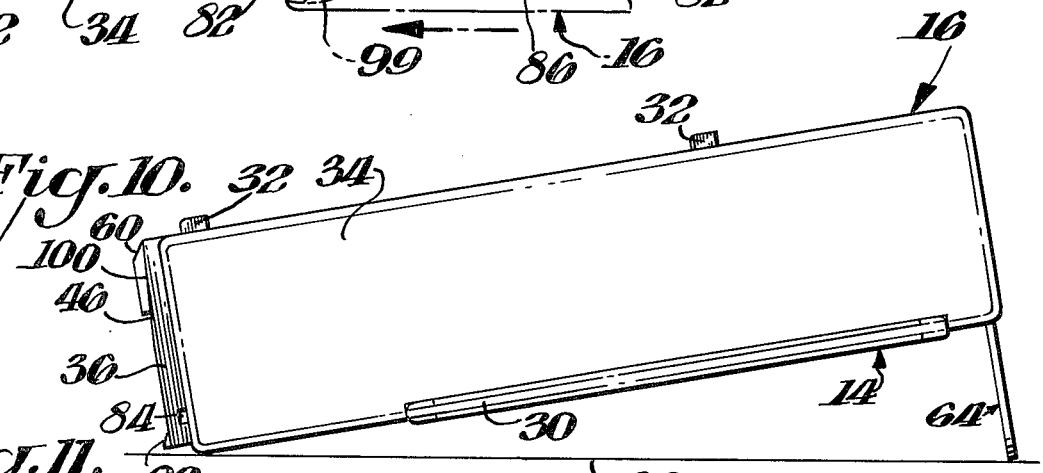
FIG. 10 is a side elevational view of the box shown in FIGS. 1–9 in open nested inverted condition supported on the foot provided by the unlocking key handle.
Figure 12:
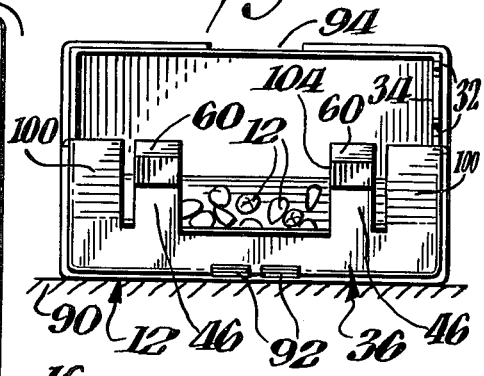
FIG. 12 is a left end elevational view of the open inverted nested box shown in FIG. 10.

FIGS. 10 and 12 show box 10 being supported on unlocking handle 64 which remains inserted through unlocking holes 58 in lid 20 of cover 16, which is accordingly disposed at an incline above a supporting surface 90. This disposes teeth 12 within tray 36 at a convenient viewing and selecting angle. FIG. 12 also shows knurled grasping projections 92 extending outwardly from the bottom of tray 36 to provide a convenient means for grasping and pulling cover 16 away from tray 36 (when unlocked) in conjunction with rim cutout 94 in the unhinged end 52 of cover 16, as also shown in FIG. 3. Arrow 96 in FIG. 3 indicates the direction of pull on knurled lugs 92 for opening the box.

Box 10, therefore, provides a very convenient means for a dentist to use and replenish a set of artificial teeth. FIGS. 10 and 12 show how open box 10 is held inclined for easy viewing and selection of artificial teeth 12 to match a particular patient's needs. After a set of teeth 12 is substantially depleted, the dentist need only slide inverted cover 16 off of tray 36 and then rotate it back over tray 36 in the opposite direction from arrows 98 in FIG. 9. Arcuate recess 99 under the rear of lid 20 provides clearance for rotation of the corner of tray 36 within it. Front edges 100 of tray 36 are inclined backwardly to produce similar rotational clearance cover 16 and to cause spring fingers 46 to protrude beyond front edges 100 for making their locking action more positive. Inclined ends 100 are separated from detent spring fingers 46 by slots 102. Spring fingers 46 are separated from each other by opening 104 in the front end of tray 36. When cover 16 closes down on tray 36, spring detent fingers 46 have their hooked ends 54 locked over shoulders 50 within the upper sides unhinged ends 52 of cover 16. This locks cover 16 down on tray 36 to provide security during mailing. When the tooth supplier receives box 10, it can open it by inserting key handle 64 through holes 58 in cover 16, as shown in FIG. 8.

While cover 16 is locked on tray 36, automatic locking lugs 32 engage within locking notches 42 in reversible address plate 14 to lock the proper address on the address plate in position until cover 16 is removed from tray 36. The procedure shown in FIG. 9 is utilized for opening cover 16 off tray 36, inverting cover 16 under tray 36, and subsequently nesting them together.

I claim:

1. A lockable shipping box comprising a tray for holding articles, a cover for the tray whereby articles in the tray are enclosed, a releasable security lock between the cover and tray for securing them together, a reversible address plate having a different address on each of the sides, a mounting means for the reversible address plate on the box constructed and arranged for receiving and holding the address plate on the box with one of its sides and the address applied thereto visibly displayed, an automatic lock between the box and reversible address plate, and the automatic locks including interengaging means on the reversible address plate which secures the reversible address plate to the box when the cover is closed over the tray, the cover has a lid and sides, one end of the cover is hinged to the tray, the hinged end of the cover being open, a pair of auxiliary guide pins extending inwardly from the inner sides of the cover adjacent its lid and open end of the cover, a pair of lower longitudinal auxiliary grooves in the lower portion of the outer sides of the tray for engagement by the inwardly extending auxiliary guide pins in the inner sides of the cover whereby the tray is helped to be guided in a sliding movement within the cover when it is rotated to an inverted position about the hinge and disposed parallel to the tray, combination rotational and slide guide pins extending outwardly from the midportion of the rear sides of the tray, longitudinal guide grooves in the middle of the inner sides of the cover for engaging with the combination rotational and slide guide pins when the tray is slid within the cover for guiding their relative sliding movement, the slide guide pins being shorter than wide, the longitudinal guide grooves having enlarged terminal hinge sockets disposed adjacent the open end of the cover which engage the width of the combination slide guide pins when the cover is rotated out of parallel with the tray whereby the cover is prevented from sliding relative to and is hinged to the tray, and a pair of arcuate guide grooves in the top of the hinged end of the sides of the tray for engaging the auxiliary slide guide pins within the inner sides of the cover when it is rotated closed upon the tray.

2. A lockable box as set forth in claim 1 wherein the releasable security lock comprises a detent spring finger means on an end of the tray and a shouldered inner locking means within an end of the cover aligned with the spring detent finger means when the cover is closed on the tray.

3. A lockable box as set forth in claim 2 wherein the detent spring finger means comprises a portion of the end of the tray separated from the tray by cutouts, and an end of the detent spring finger being tapered to permit it to be cammed out to unlock it from the shouldered inner locking means.

4. A lockable box as set forth in claim 2 wherein the cover includes a lid, holes are provided in the lid in line with the detent spring finger means when the cover is closed on the tray whereby key rod means may be inserted through the holes for disengaging the detent spring finger means from the shouldered inner locking means for unlocking the box.

5. A lockable box as set forth in claim 4 wherein a hinge connection is provided between one end of the cover and the corresponding end of the tray when the box is closed whereby the cover is hinged to the tray at one end of the box, and the releasable security lock being disposed at the opposite end of the box from the hinge.

6. A lockable box as set forth in claim 5 whereby a projection is provided at the bottom of the locked end of the tray, and a rim cutout section is provided in the end of the cover adjacent the projection whereby the projection and rim cutout section may be grasped to pull the cover off the tray.

7. A lockable box as set forth in claim 1 wherein locking rod means having a tapered end is provided, the unlocking rod means being constructed and arranged to also have a foot support for the opened inverted box.

8. A lockable box as set forth in claim 1 wherein the combination slide guide pins have upper and lower flats and arcuate front and rear surfaces.

9. A lockable box as set forth in claim 8 wherein the upper front edges of the locked end of the tray are inclined inwardly to provide clearance for rotation within the corresponding end of the cover and to cause the detent spring fingers to define the outer extremity of the end of the tray.

10. A lockable shipping box comprising a tray for holding articles, a cover for the tray whereby articles in the tray are enclosed, a releasable security lock between the cover and tray for securing them together, a reversible address plate having a different address on each of the sides, a mounting means for the reversible address plate on the box constructed and arranged for receiving and holding the address plate on the box with one of its sides and the address applied thereto visibly displayed, an automatic lock between the box and reversible address plate, and the automatic lock including interengaging means on the reversible address plate which secures the reversible address plate to the box when the cover is closed over the tray, the cover has a lid, the reversible address plate includes a locking notch means in one end thereof disposed substantially in line with a side of the tray when the cover is closed down upon the tray, a locking lug means extending upwardly from the aligned side of the tray for engaging the locking notch means when the cover is closed on the tray, hole means on the lid of the cover in line within the locking notch means, whereby the locking lug means is allowed to enter into and engage into the locking notch means when the cover is closed on the tray, a rectangular cutout in the lid of the cover disposed adjacent one side of the cover and extending through it to expose the edges of the cutout on the lid, and the reversible address plate having grooved edges for engaging the exposed edges in the lid whereby the reversible address plate is held in engagement with the cutout in the lid.

11. A lockable box as set forth in claim 10 wherein three edges of the reversible address plate include grooved edges for engaging over three exposed edges in the cutout in the lid.

12. A lockable box as set forth in claim 10 wherein the inside of the lid at the open rear of the cover is arcuately relieved to facilitate rotation of the hinged cover to the open and closed positions about the top of the hinged end of the tray.

13. A lockable box as set forth in claim 10 wherein pairs of locking notch means, locking lug means and address plate locking holes are provided.

* * * * *